United States Patent [19]

Holcblat

[11] Patent Number: 4,898,123

[45] Date of Patent: Feb. 6, 1990

[54] WATER CLEANSING TANK FOR STEAM GENERATOR

[75] Inventor: Alain Holcblat, Issly les Moulineaux, France

[73] Assignee: Framatome, Courbevoie, France

[21] Appl. No.: 208,624

[22] Filed: Jun. 20, 1988

[30] Foreign Application Priority Data

Jun. 18, 1987 [FR] France ..... 87 08517

[51] Int. Cl.[4] ..... F22B 37/18; F22B 37/48

[52] U.S. Cl. ..... 122/379; 122/491; 122/492

[58] Field of Search ..... 122/381, 382, 383, 488, 122/489, 491, 492, 379

[56] References Cited

U.S. PATENT DOCUMENTS

| | | | |
|---|---|---|---|
| 4,522,156 | 6/1985 | Chaix | 122/488 X |
| 4,624,686 | 11/1986 | Andrieux et al. | 122/491 X |
| 4,664,069 | 5/1987 | Alden, Jr. | 122/381 |
| 4,717,400 | 1/1988 | Ozeki et al. | 122/488 X |
| 4,762,091 | 8/1988 | Smith, Jr. | 122/381 X |

*Primary Examiner*—Edward G. Favors

*Attorney, Agent, or Firm*—Pollock, Vande Sande & Priddy

[57] ABSTRACT

A water-cleansing tank for steam generators is disclosed. It consists of a bottom, a side wall and a roof. It has a conduit which encompasses the lower end of a drain (20) collecting the water to be cleansed. Side holes provide for a calm flow inside the cleansing tank and for the depositing, by gravity, of the polluting particles. The overall arrangement is simple and efficient. The invention can be applied to nuclear power plants.

9 Claims, 3 Drawing Sheets

WATER CLEANSING TANK FOR STEAM GENERATOR

BACKGROUND OF THE INVENTION

1. Field of the Invention

An object of the present invention is a water cleansing tank for steam generators.

In steam generators, the water in the secondary circuit contains particles which are mainly products of oxidation such as magnetite. These particles tend to get deposited in zones where there is a low flowing speed, especially near the tube plate, thus promoting the corrosion of the heat exchange tubes.

2. Description of the Prior Art

This is why attempts have already been made to build devices comprising cleansing tanks in which these particles accumulate pending their removal. The prior art in this field includes three patents filed on behalf of the firm Westinghouse and respectively extended to France under Nos. 2 462 655 and 2 564 949 and to Europe under No. 0 185 174.

The inventions of these three patents concern cleansing tanks placed on the horizontal roof of a casing containing the tubes in which the primary fluid flows. The water of the secondary circuit of the steam generator, which undergoes cleansing, flows downwards between the shell of the steam generator and the casing of the bank of tubes, then flows upwards inside the casing. It then gets evaporated in contact with the tubes and rises in the vertical conduits that go through the roof of the casing. Various devices placed at the top of the steam generator, in the two-phase zone, are used to dry the steam produced by separating it from the water that it still contains. Devices of this type are cyclone devices which work by centrifugation and herringbone-structure driers.

This water, separated from the vapor phase, is more charged with particles than the water in the water-return conduits or the water at the bottom of the bank because the boiling process concentrates the solid particles in the non-evaporated water. As a rule, it flows up to a cleansing tank located on the roof of the casing of the bank where it is decanted before being recycled. The particles are deposited at the bottom of the tank and are allowed to stay there in this state until the tank is drained. These draining operations can be done between two operating cycles or during one cycle, by means of a special device comprising a water-sprinkling tube and a drainage or extraction tube.

In the first of these patents, the cleansing tank is open at the top. Its bottom consists of the roof of the casing and its side wall is cylindrical and vertical. The water accumulates until it overflows, and flows in a cascade above the upper shoulder of the side wall. It is then recycled. The drainage is provided by an extraction tube that opens out into the center of the bottom of the tank.

This device has the following disadvantage: since the cyclone devices and driers are distributed throughout the surface of the steam generator, the side wall of the tank should have a large diameter. In practice, this diameter should be almost as large as that of the shell of the steam generator itself, so as to encompass all the paths through which the water, which is separated from the steam, runs. The result of this is that, during construction, it is necessary to move and set up a very large-sized plate in the upper parts of the steam generator which are difficult to reach.

The other disadvantage is due to the extraction tube which makes it necessary to pierce the casing at two places: through the roof and on the side wall. This extraction tube also makes it necessary to pierce the shell of the steam generator itself, thus creating brittle zones.

The second patent proposes a less cumbersome method since the single tank is replaced by small closed tanks with perforated tops. These tanks are placed entirely in liquid phase. The particle-charged water flows above them, and a part of this water enters them. Since the flowing speed is very low inside, the particles are deposited at the bottom of the tanks. The extraction device is complemented by a spraying device consisting of a tube that enters the tank through the top and ends in radial nozzles which spray its interior like a shower sprinkler.

This device removes the drawback of the big tank. However, since the extraction device is the same as that of the previous approach, it has the same drawbacks and it must be acknowledged that another drawback appears with this approach: the particle-charged water flows erratically over the perforated bottoms of the various tanks, and the quantity that actually goes therein is not known. The efficiency of the device is therefore uncertain.

In the third patent, the casing that contains the bank of tubes has a triple top in the form of three horizontal plates. The top plate is perforated, the median plate has a central hole and does not extend radially up to the edge of the casing, and the lower plate, which is impervious to fluids, corresponds to the roof of the casing.

The water to be cleansed flows, as in the above approach, over the upper perforated plate and penetrates this plate. It goes towards the central hole of the median plate which it therefore crosses, also downwards. It then enters a device of deflectors which give it a laminar flow suitable for the depositing of the particles. The water then flows towards the edge of the envelope and is recycled after having gone through a vertical movement which makes it flow out of the median plate and through the edge holes of the perforated plate. In this device, no special drainage or extraction means are provided.

The drawbacks of this approach can be summarized as follows: as in the preceding approach there is no basis whatsoever for asserting that the particle-charged water actually penetrates the holes of the perforated plate and that it is not recycled directly. And, above all, the deflector devices have to be placed in relatively narrow spaces between two horizontal plates and the big tubes, conveying the water/steam mixture, which go through these plates. It can therefore be concluded that the assembly of these deflectors is very complicated.

Finally, the absence of the drainage device may entail relatively short operating cycles.

An object of the invention is to overcome these various drawbacks and, more especially, the drawback related to perforated lids which do not ensure high efficiency in the cleansing tank.

A special object of the invention is, therefore, to propose a cleansing tank which is practically an enclosed casing, with the exception of holes which may be small-sized if necessary and are used for discharging, and an upper conduit enabling a tube, through which the particle-charged water flows, to open out into the tank.

SUMMARY OF THE INVENTION

More precisely, the invention relates to a tank for the cleansing of water flowing in a steam generator, said water being separated from the steam by drying means and having flowed through a tube for the inlet of water into the tank, said tank comprising a casing consisting of a bottom, a side wall drilled with water-removal holes and a roof drilled with a central conduit into which the lower end of the tube penetrates.

The invention can also be applied to certain steam generators in which the construction necessitates the ability, as the case may be, to have the water placed in the tank quickly available for cooling purposes. Thus, the holes are extended by vertical slits which extend towards the bottom and so enable fast and almost complete drainage of the tank as required.

In the preferred embodiment, the drainage device comprises a water sprinkler tube, which is tangential to the bottom, going through a median line of this bottom and drilled with holes that enable sprinkling in a direction tangential to the bottom, as well as a recovery tube which communicates with the tank through connection pieces crossing said tank near the junction between its bottom and its side wall.

BRIEF DESCRIPTION OF THE DRAWINGS

The description will now be made with the help of the following figures which are given purely by way of illustration and in no way restrict the scope of the invention. Of these figures.

DESCRIPTION OF A PREFERRED EMBODIMENT

Figure 1:
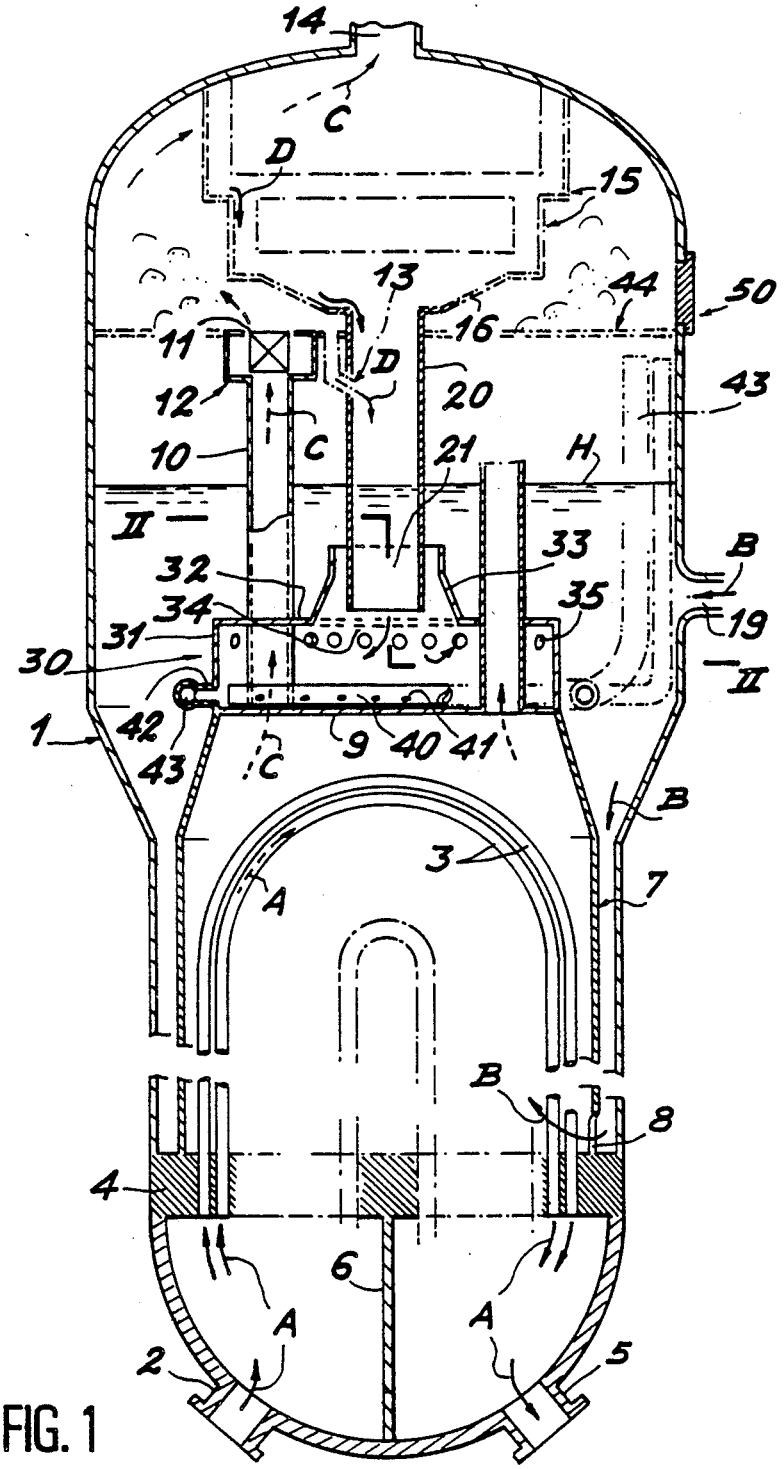
FIG. 1 shows a diametral section of a steam generator fitted with the device of the invention.

Referring to FIG. 1, we shall first briefly recall the broad principles of the operation of a generator and of the water recovery mode.

The primary water flows in the direction of the arrows A. It enters firstly the inside of the bottom of the casing 1 through a primary input pipe 2 and flows inside U-shaped reversed tubes 3. The ends of the arms of these U-shaped tubes 3 are fixed to a tubular plate 4. The primary water comes out of the tubes 3 and then leaves the steam generator through a primary outlet conduit 5. A separating plate 6 is placed between the tube plate 4 and the chamber 1 of the steam generator so as to force the primary fluid to flow through the tubes 3.

The secondary water flows in the direction of the arrows B, C and D. It first penetrates the inside of the chamber 1 of the steam generator through a secondary inlet conduit 19 complemented by a supply device not shown herein. The water in liquid phase flows towards the bottom of the steam generator, between the chamber 1 and a casing 7 inside this chamber 1. This casing 7 is concentric with the chamber 1 and has the tubes 3 within it. The secondary water is stopped by the tubular plate 4 and then flows radially towards the inside of the steam generator, flowing through holes 8 made between the bottom of the casing 7 and the tubular plate 4. The secondary water then rises, is heated up in contact with the tubes 3 and gets partially evaporated. The flow of damp steam is shown, more particularly, by the arrows C. The water/steam mixture then rises to the roof 9 of the casing 7 which is also the bottom of the cleansing tank which shall be described below. This water/steam mixture flows in the vertical pipes 10 communicating with the inside of the casing 7 through holes drilled in the roof 9. The water/steam mixture rises to the top of the steam generator 1 but it is still very highly charged with humidity. This is why devices to separate steam from water are provided for. Firstly, cyclone devices 11 are provided at the top of the tubes 10. These cyclone devices perform a first separation by centrifugation of the drops of water suspended in the steam. The water thus collected flows through collector devices 12 and then flows by gravity (downwards), along the tubes 10 outside these tubes until it reaches the liquid/steam interface H.

As a rule, the tops of the cyclone devices are braced by a solid plate 44, fitted with drains 13 used to remove the drops which have not been separated by the cyclone devices and which fall by gravity. These drains 13 can open out into the vertical drain 20 which itself opens out into a cleansing tank 30 described below. The water separated by gravity is cleansed by the device proposed by the inventor.

The damp steam continues to rise in the direction of the arrows C until it leaves the chamber 1 of the steam generator through a secondary output conduit 14 but, in the meantime, it goes through the driers 15 which are structures suspended to the top of the casing 1 and in which the drops contained in the steam, which have not been centrifugated by the cyclones 11, are picked up by corrugated metal sheets. This residual water is charged with solid particles and must be cleansed. This water may even draw along particles which get detached from these sheets following accidental oxidation during a stoppage. In this case, the water coming from the driers is more charged than the water that is re-circulated by the cyclone devices, and the proposed device has the advantage of cleansing the water from the driers before it is mixed with the rest of the re-circulated water. The drops flow, by gravity, firstly, along the driers 15 and then inside a collecting pan 16 suspended from the driers 15, where they collect and, finally, flow inside a vertical drain 20 which collects the water from the collecting pan 16 as well as any water that falls from the drains 13. The path taken by this water is shown by the arrows D.

The drain 20 opens out, at its lower end 21, into a cleansing tank 30 which is placed under the liquid/-steam interface H, constitutes the object of the invention and will now be described in detail.

The cleansing tank 30 has a generally cylindrically shape and includes a bottom 9 which is here identified with the roof of the casing 7, a lateral wall 31 and a roof 32. The bottom 9 and the roof 32 may be crossed, in the case of a large-diameter tank 30, by vertical conduits 10 which convey the water/steam mixture. The roof 32 is drilled with a conduit 33 consisting of a cylindrical sleeve placed in the center of the roof 32. The drain 20 penetrates into the interior of the conduit 33 and has a slight clearance with respect to the sleeve so as to tolerate heat expansion and positioning uncertainties due to manufacture.

The conduit 33 is obstructed by a grate 34 which is supported on the roof 32. The lower end 21 of the drain 20 is on top of the grate 34. The utility of the grate 34 is that it creates charge losses in the water flowing through the drain 20 and, especially, that it quickly reduces the vertical component of the speed of this water.

Figure 3:
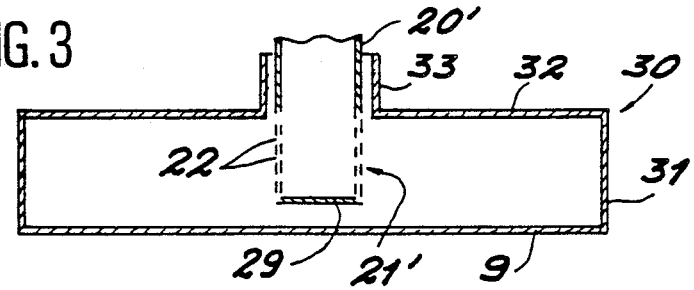
FIG. 3 and FIG. 4 show two possible alternatives of the structure according to the invention.

According to another manner of conceiving the invention, shown in FIG. 3, the same result can be achieved with a drain 20' that penetrates more deeply into the cleansing tank 30 and which has its lower end 21' appreciably below the roof 32. The section of the drain 20' is not open but is blocked by a plate 29, and the water flows out of the drain 20' radially through the holes 22 drilled in the circumference of the drain 20' beneath the roof 32.

The water penetrating the drain 20 (or 20') in the cleansing tank 30 loses its suspended polluting particles through the fact that these particles are deposited on the bottom 9. This is achieved by creating a flow which is as laminar and as calm as possible, especially at the bottom of the tank 30 so that already deposited particles are not again drawn along. Discharging holes 35, evenly distributed along the side wall 31 and set at one and the same level in the top part of this said side wall 31, provide for a radial flow of water according to these characteristics. The radial flow enables the water that penetrates the cleansing tank 30 to be greatly slowed down, and the long transit time promotes the depositing of the particles at the bottom 9. Furthermore, the lower part of the tank 30 is hardly implicated in the flow and therefore constitutes a calm zone.

The cleansed water that leave the holes 35 is then mixed with the general flow represented by the arrows B.

Figure 4:
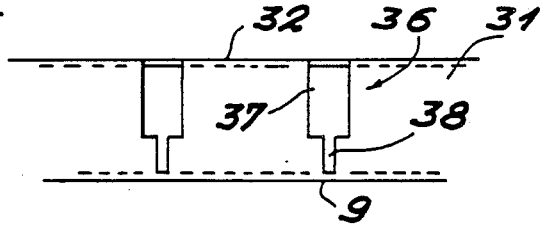

In certain steam generators, it may, however, be necessary to have most of the water contained in the cleansing tank 30 very quickly available to enable cooling if the unit gets overheated. The discharge holes 35 shown in FIG. 1, which are small, then prove to be inadequate. This is why, as shown in FIG. 4, these holes 35 can be replaced by larger-sized holes and can be made up of two parts. The upper part, which can extend to the roof 32, is a circular or rectangular hole 37. The lower part is a slit 38 that extends downwards and forms an extension of the hole 37. It can extend up to the bottom 9. This arrangement ensures that a very fast flow of water can be obtained outside the cleansing tank and ensures that the tank will be almost completely empty. It is clear that cleansing efficiency is somewhat reduced by the more turbulent flow in the cleansing tank 30, but ths loss can be accepted because the width of the slits 38 remains small enough to prevent excessive flow at the bottom of the cleansing tank 30 during steady operation.

The cleansing tank 30 according to the invention therefore has various advantages as compared with the known methods disclosed in the patents referred to.

Since the tank is almost entirely closed, the particles deposited are protected from external flows in the entire generator, and there is a low risk of re-emulsification during any accidental drainage of the tank.

The closed nature of the device makes it possible to maintain the same efficiency regardless of its environment, especially if the tank 30 is entirely in liquid phase.

Owing to direct supply through a drain 20 crossing a conduit 33 and opening out into the center of the tank, an internal radial flow is created, the speed of which diminishes quickly from the center to the edge.

In terms of both speed and direction, the flow is thus controlled more efficiently than in the other two above-mentioned patents. This control over the flow makes it possible to avoid two dangers:

(a) An excessive flow rate resulting in a travelling time which is too short for the particles to be deposited.

(b) A flow rate of liquid and, hence, of particles which is negligible as compared with the total flow rate of water re-circulated by the separation system.

We are therefore be entitled to expect far greater efficiency from the above-described installation than from the designs described in the prior art referred to.

Figure 2:
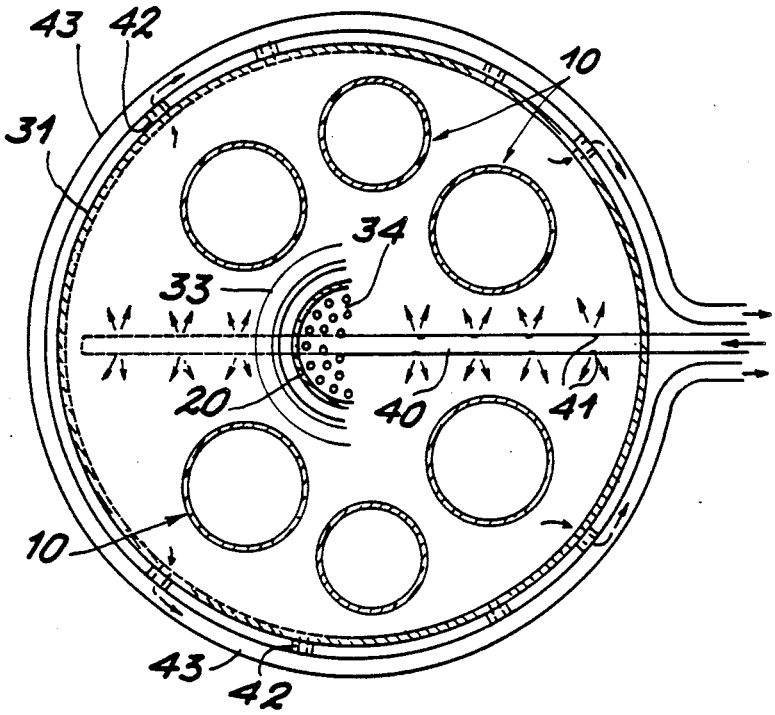
FIG. 2 shows a section along the line II—II of FIG. 1.

The particles collected in the cleansing tank 30 by depositing can be drained or extracted in various ways. The preferred approach shall now be described, but other approaches are clearly possible. FIGS. 1 and 2 shall be referred to simultaneously.

A sprinkler tube 40 goes inside the cleansing tank 30 and to the bottom 9. The sprinkler tube 40 is rectilinear in the cleansing tank 30 and is arranged along a central or diametral path. It is drilled with horizontal sprinkler holes 41 thus enabling, at the draining instant, a flow of sprinkling water which is either horizontal or tangential to the bottom 9.

The particles flow in the form of sludge, pushed back by the sprinkled water towards the edge of the cleansing tank 30. These particles then go into the joining pieces 42 which are placed along the side wall 31, in the vicinity of the bottom 9, and which make the inside of the cleansing tank communicate with a recovery tube 43 shaped like a ring around the side wall 31 outside it. The sludge can then be sucked out and collected.

Figure 5:
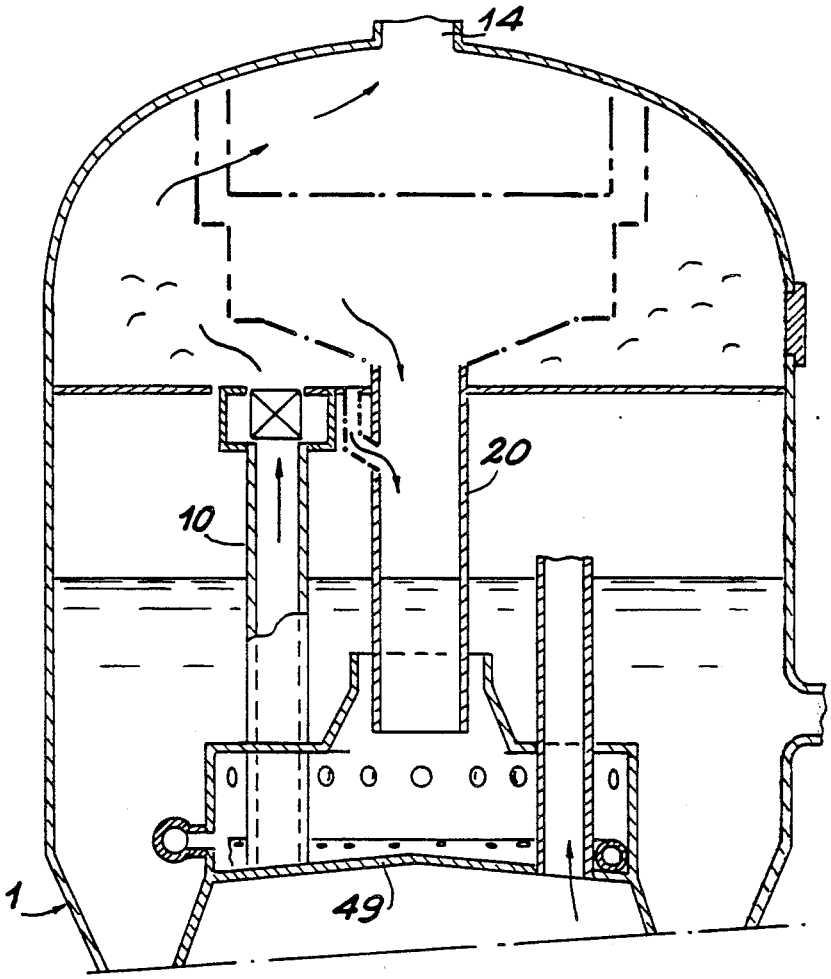
FIG. 5 shows a slightly different structure of the steam generator and the tank.

In general, the bottom 9 of the tank is flat and horizontal. However, when the available space allows it, it can be given a concave shape and, more especially, a cone shape, with the vertex pointed upwards, having a vertical axis and having a wide angular aperture (a vertex angle ranging between 170° and 160°). This is shown in FIG. 5 where this new bottom is marked 49. For a given depth at the center, the slight slope thus obtained has the following advantages:

(a) The risk of letting the water stagnate on the roof, when the steam generator is drained during the annual shutdown, is removed. This thus facilitates the dry conditioning of the steam generator as compared with a flat roof which may have planeity faults (even small ones) capable of retaining water.

(b) The re-circulation vortex which is formed at the edge favors the depositing of the particles, thus favoring removal by suction.

The suction tube 40 and the recovery tube 43 pass neither through the casing 7 nor through the chamber 1, but are curved back upwards and open out above the interface H near a secondary manhole 50. When the operation of the steam generator is interrupted, it thus becomes easy to open the lid of the manhole and connect the sprinkling and recovery tubes 40 and 43 to pumps.

What is claimed is:

1. A tank for the cleansing of water flowing in a steam generator, said water being separated from the steam by drying means and having flowed through a tube for the inlet of water into the tank, said tank comprising a casing consisting of a bottom, a side wall drilled with water-removal holes and a roof drilled with a central conduit into which the lower end of the tube penetrates.

2. A water cleansing tank according to claim 1 wherein the tank is located beneath a water/steam interface in the generator.

3. A water cleansing tank according to claim 1 wherein the conduit comprises a cylindrical sleeve surrounding the lower edge of the tube.

4. A water cleansing tank according to claim 3 wherein the conduit comprises a grate placed under the cylindrical sleeve and beneath the tube.

5. A water cleansing tank according to claim 1 wherein the lower end of the tube is blocked by a plate and is provided with drilled holes beneath the roof, enabling a horizontal flow of the water leaving the tube.

6. A water cleansing tank according to claim 1 wherein the holes are small-sized and evenly distributed at one and the same level close to the roof.

7. A water cleansing tank according to claim 1 wherein the holes are extended by vertical slits which extend towards the bottom.

8. A water cleansing tank according to claim 1 comprising at least one tube for sprinkling water tangentially to the bottom, said tube passing through a median line of this bottom and being drilled with holes that enable sprinkling tangentially to the bottom, as well as a recovery tube communicating with the tank through joining pieces that cross said tank near the junction of the bottom and its side wall.

9. A water cleansing tank according to claim 1 wherein its bottom is concave-shaped.

* * * * *